US008899604B2

(12) United States Patent
Orenstein et al.

(10) Patent No.: US 8,899,604 B2
(45) Date of Patent: Dec. 2, 2014

(54) WHEELED SCOOTER

(75) Inventors: Amber Orenstein, Prior Lake, MN (US); Louis F. Polk, III, Excelsior, MN (US); Jason Ness, Victoria, MN (US)

(73) Assignee: The Prophet Corporation, Owatonna, MN (US)

( * ) Notice: Subject to any disclaimer, the term of this patent is extended or adjusted under 35 U.S.C. 154(b) by 84 days.

(21) Appl. No.: 13/175,609

(22) Filed: Jul. 1, 2011

(65) Prior Publication Data

US 2013/0001916 A1 Jan. 3, 2013

(51) Int. Cl.

| | |
|---|---|
| ***A61H 3/04*** | (2006.01) |
| ***A63C 17/00*** | (2006.01) |
| ***A63C 17/26*** | (2006.01) |
| ***A63C 17/04*** | (2006.01) |
| ***A63C 17/28*** | (2006.01) |

(52) U.S. Cl.

CPC ..... *A63C 17/0026* (2013.01); *A63C 2203/44* (2013.01); *A63C 17/0033* (2013.01); *A63C 17/265* (2013.01); *A63C 17/04* (2013.01); *A63C 17/28* (2013.01); *A63C 2203/42* (2013.01)

USPC ..... 280/200; 280/79.11

(58) Field of Classification Search

USPC ..... 280/79.11, 87.01, 87.021, 87.05, 280/87.041, 32.6, 242.1, 33.991, 33.993, 280/33.998, 62; D21/419; D34/28

See application file for complete search history.

(56) References Cited

U.S. PATENT DOCUMENTS

| | | | | | |
|---|---|---|---|---|---|
| 211,401 | A | * | 1/1879 | Harper | 280/62 |
| 422,729 | A | * | 3/1890 | Clark | 248/129 |
| 726,035 | A | * | 4/1903 | Dorsey | 280/62 |
| 824,422 | A | * | 6/1906 | Harper | 280/62 |
| 865,601 | A | * | 9/1907 | Loyd | 280/47.12 |
| 905,050 | A | * | 11/1908 | Birch | 280/62 |
| 1,052,722 | A | | 2/1913 | Hegel | |
| 1,267,050 | A | | 5/1918 | Brigel | |
| 1,467,453 | A | | 9/1923 | Remacle | |
| 1,510,585 | A | | 10/1924 | Cushing, Sr. et al. | |
| 1,666,139 | A | * | 4/1928 | Johnson | 280/62 |
| 1,881,335 | A | * | 10/1932 | Ulmer | 248/129 |
| 2,246,628 | A | | 6/1941 | Heckman | |
| 2,288,568 | A | | 6/1942 | Holmes | |
| 2,351,293 | A | | 6/1944 | Saunders | |
| 2,537,554 | A | * | 1/1951 | Seely | 254/1 |
| 2,932,528 | A | | 4/1960 | Miller et al. | |
| 2,980,435 | A | * | 4/1961 | Brett | 280/43 |
| 3,094,340 | A | | 6/1963 | Richardson et al. | |
| 3,197,227 | A | | 7/1965 | Anselmo | |
| 3,339,939 | A | | 9/1967 | Bowers | |

(Continued)

OTHER PUBLICATIONS

Gopher Catalog, front cover and pp. A1 -A2 and 30-33 (2001).

(Continued)

*Primary Examiner* — Joseph M Rocca

*Assistant Examiner* — Conan Duda

(74) *Attorney, Agent, or Firm* — Merchant & Gould P.C.

(57) ABSTRACT

A scooter includes a main body having a triangular shape including three lower pivotable wheels. Three handles are defined interior to the main body, one along each of the sides. The body includes a domed shape and a textured surface. A central opening is provided in the main body to allow for stacking of the scooters for storage. During stacking, the scooters are alternated relative to one another so that the points and the sides are offset, resulting in compact and secure storage.

19 Claims, 8 Drawing Sheets

(56) References Cited

U.S. PATENT DOCUMENTS

| | | | | | |
|---|---|---|---|---|---|
| 3,374,000 | A | | 3/1968 | Wetzel | |
| 3,567,242 | A | | 3/1971 | Miller | |
| 3,604,722 | A | | 9/1971 | Boley | |
| 3,613,307 | A | | 10/1971 | Baynes et al. | |
| 3,633,774 | A | | 1/1972 | Lee | |
| 3,705,730 | A | | 12/1972 | Bergsland | |
| 3,822,069 | A | | 7/1974 | Hoff | |
| 3,870,334 | A | | 3/1975 | Cole | |
| D236,743 | S | | 9/1975 | Moustakas | |
| 3,944,258 | A | | 3/1976 | Christensen | |
| 4,002,352 | A | | 1/1977 | Hager | |
| 4,029,330 | A | * | 6/1977 | Runyan, Jr. | 280/87.042 |
| 4,062,557 | A | | 12/1977 | Roden | |
| 4,077,644 | A | | 3/1978 | Roby et al. | |
| 4,129,315 | A | | 12/1978 | McCallum | |
| 4,134,599 | A | * | 1/1979 | DiMille et al. | 280/87.01 |
| 4,203,609 | A | | 5/1980 | Mitchell et al. | |
| 4,218,062 | A | * | 8/1980 | Brooks, Jr. | 273/108 |
| 4,295,656 | A | * | 10/1981 | Moore | 280/87.042 |
| D266,100 | S | | 9/1982 | Miller | |
| 4,458,906 | A | | 7/1984 | Lamson | |
| 5,046,750 | A | | 9/1991 | Heubl | |
| 5,052,703 | A | | 10/1991 | Bertrand | |
| 5,074,572 | A | * | 12/1991 | Delmerico et al. | 280/47.34 |
| 5,098,087 | A | | 3/1992 | Matile et al. | |
| 5,106,109 | A | | 4/1992 | Tattersall et al. | |
| D356,412 | S | | 3/1995 | Hensley, Jr. | |
| D367,140 | S | | 2/1996 | Reese | |
| 5,524,915 | A | | 6/1996 | Liu | |
| 5,527,051 | A | | 6/1996 | Plaza | |
| 5,551,715 | A | | 9/1996 | Pickard | |
| D378,154 | S | | 2/1997 | Presnell | |
| 5,632,497 | A | | 5/1997 | Murray | |
| D381,171 | S | | 7/1997 | Culverson | |
| D389,973 | S | | 1/1998 | Murray | |
| D390,314 | S | | 2/1998 | Chen | |
| 5,810,376 | A | | 9/1998 | Matheny | |
| 5,823,549 | A | * | 10/1998 | Morgan, Jr. | 280/33.998 |
| 5,863,053 | A | | 1/1999 | Berry | |
| D414,305 | S | | 9/1999 | Rohn et al. | |
| 5,947,489 | A | | 9/1999 | Tucker | |
| 5,947,495 | A | | 9/1999 | Null et al. | |
| 5,947,794 | A | | 9/1999 | McGrath | |
| 5,957,482 | A | | 9/1999 | Shorter | |
| 5,992,865 | A | | 11/1999 | Vargas | |
| 6,095,348 | A | | 8/2000 | Karashima | |
| 6,199,880 | B1 | | 3/2001 | Favorito et al. | |
| 6,213,484 | B1 | | 4/2001 | Rohner | |
| D446,264 | S | * | 8/2001 | Fischer et al. | D21/662 |
| 6,276,471 | B1 | | 8/2001 | Kratzenberg et al. | |
| 6,276,700 | B1 | | 8/2001 | Way et al. | |
| 6,419,248 | B1 | | 7/2002 | Kay | |
| D461,614 | S | | 8/2002 | Liu | |
| D466,560 | S | | 12/2002 | Stolpmann | |
| 6,550,794 | B1 | | 4/2003 | Spindel et al. | |
| 6,561,530 | B2 | * | 5/2003 | Carbonero | 280/87.041 |
| 6,767,264 | B2 | * | 7/2004 | Mercer | 441/65 |
| D494,335 | S | | 8/2004 | Oberg | |
| 6,776,427 | B2 | | 8/2004 | Glover | |
| D500,346 | S | | 12/2004 | Glover | |
| D503,838 | S | | 4/2005 | Archambault | |
| 6,893,032 | B2 | | 5/2005 | Kershaw | |
| D513,353 | S | | 12/2005 | Pederson | |
| 7,213,819 | B2 | * | 5/2007 | Carbonero | 280/79.11 |
| 7,226,062 | B1 | * | 6/2007 | Stefano | 280/87.041 |
| D549,920 | S | | 8/2007 | Dukes | |
| D645,925 | S | | 9/2011 | Sramek | |
| 2002/0158437 | A1 | | 10/2002 | Carbonero | |
| 2004/0235388 | A1 | * | 11/2004 | Padilla | 446/269 |
| 2008/0169216 | A1 | * | 7/2008 | Kaltz | 206/507 |
| 2009/0267313 | A1 | * | 10/2009 | Kalajyan | 280/33.998 |
| 2011/0006497 | A1 | * | 1/2011 | Chen et al. | 280/87.042 |
| 2011/0118088 | A1 | | 5/2011 | Caya et al. | |
| 2012/0256385 | A1 | * | 10/2012 | Pujol | 280/79.11 |

OTHER PUBLICATIONS

Gopher Catalog, front cover and pp. A1 and 48-54 (Fall 2006).
Gopher Catalog, front cover and pp. 21 and 50-59 (Spring 2010).
Design U.S. Appl. No. 29/396,602, filed Jul. 1, 2011 entitled Scooter.
Notice of Allowance for U.S. Appl. No. 29/396,602 mailed Feb. 28, 2013.

* cited by examiner

WHEELED SCOOTER

FIELD OF THE INVENTION

The present invention relates to a wheeled scooter.

BACKGROUND

Wheeled scooters are known for sliding across surfaces such as gymnasium floors or outdoor exercise or play areas. The wheeled scooter is non-motorized and is ridden by a user for exercise, playing games or entertainment purposes. Improvements are desired.

SUMMARY

One aspect of the invention relates to a scooter including a main body having a triangular shape including three equal sides and three equal points, and three wheels. One of the wheels is located adjacent to each point. Each of the wheels includes a swivel caster wheel. Three handles are provided, wherein each handle is defined by an opening through the main body. One of the handles is located adjacent to a center of each side.

In one embodiment, the main body has a domed shaped top surface with a highest location adjacent to a center of the main body and a plurality of lower locations adjacent each of the three points.

In another embodiment, the top surface includes a textured surface.

In a further embodiment, the openings which form the handles are located within the outer perimeter of the main body, wherein the sides define outwardly bowed shapes extending between the points.

In one embodiment, the main body includes a central opening extending vertically through the main body. The central opening preferably includes an upper main diameter portion and a lower smaller diameter portion. The central opening allows stacking wherein the lower smaller diameter portion of a first scooter of a plurality of separate scooters is sized to be received in the upper main diameter portion of a second scooter of the plurality of the separate scooters positioned below the first scooter, wherein the wheels of the first scooter positioned above the second scooter do not interfere with the scooter below. In a preferred arrangement, the scooters are alternated in the stack wherein the alternating scooters are oriented at 60 degrees offset.

Another aspect of the invention relates to a scooter body including: a main body having a triangular shape including three equal sides and three equal points; three wheels mounts, one of the wheel mounts being located adjacent to each point; three handles, each handle defined by an opening through the main body, one of the handles being located adjacent to a center of each side. The main body has a domed shaped top surface with a highest location adjacent to a center of the main body and a plurality of lower locations adjacent each of the three points. The main body defines a carrying handle adjacent to each handle, the carrying handle having a thinner vertical dimension than portions of the sides on opposite ends of the carrying handle.

A further aspect of the invention relates to stack of scooters and a related method of stacking including a plurality of separate scooters, each scooter including:

a main body having a triangular shape including three equal sides and three equal points;

three wheels, one of the wheels being located adjacent to each point, each of the wheels including a swivel caster wheel;

three handles, each handle defined by an opening through the main body, one of the handles being located adjacent to a center of each side;

the main body having a domed shaped top surface with a highest location adjacent to a center of the main body and a plurality of lower locations adjacent each of the three points;

the main body having a central opening extending vertically through the main body, wherein the central opening including a upper main diameter portion and a lower smaller diameter portion;

wherein the scooters are stacked and alternated back and forth in a repeating pattern along central vertical axis, wherein the lower smaller diameter portion of a first scooter of the plurality of the separate scooters is sized to be received in the upper main diameter portion of a second scooter of the plurality of the separate scooters positioned below the first scooter, wherein the wheels of the first scooter positioned above the second scooter do not interfere with the scooter below, wherein the alternating scooters are oriented at 60 degrees offset.

In one embodiment of the stack of scooters, the main body of each scooter includes a carrying handle adjacent to each handle, the carrying handle having a thinner vertical dimension than portions of the sides on opposite ends of the carrying handle.

DETAILED DESCRIPTION OF THE PREFERRED EMBODIMENT

Figure 1:
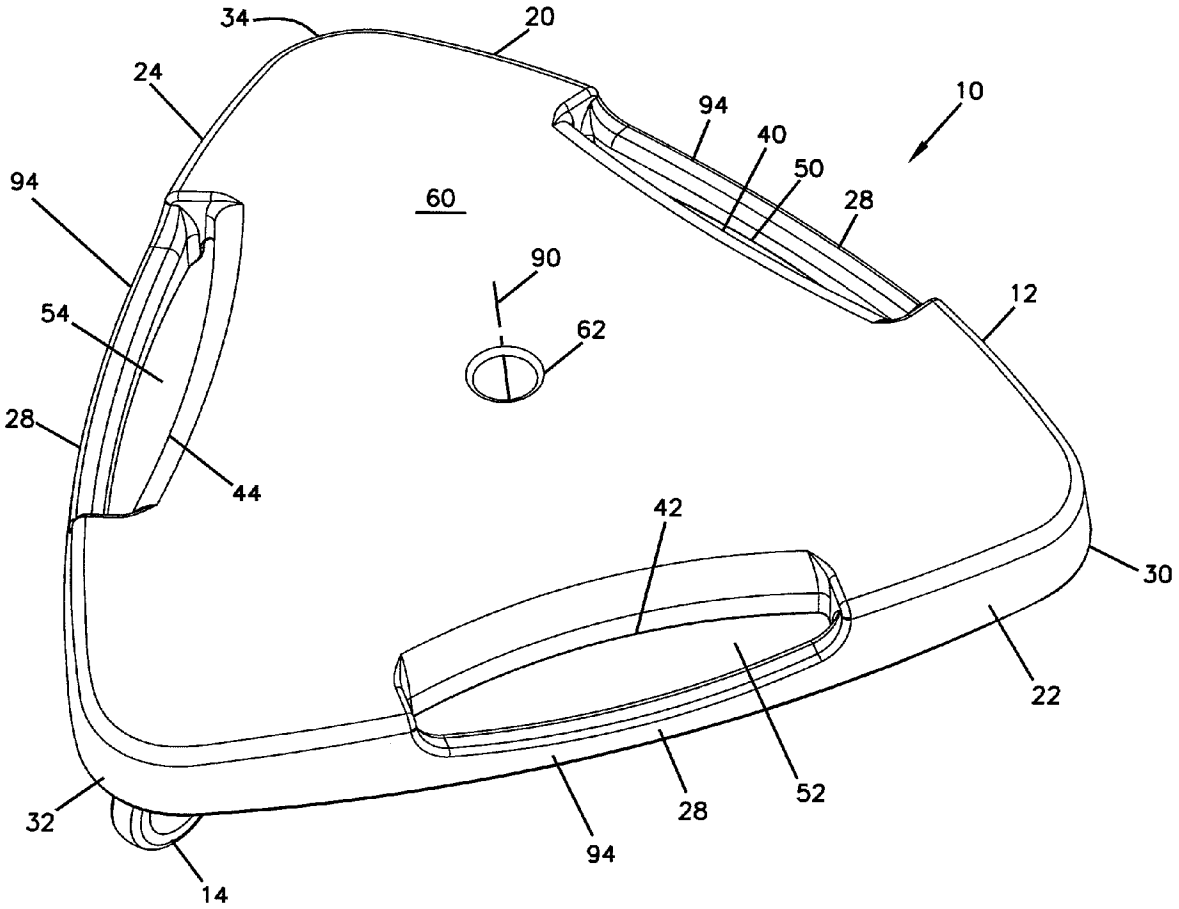
FIG. 1 is a perspective view of a first embodiment of a scooter.
Figure 2:
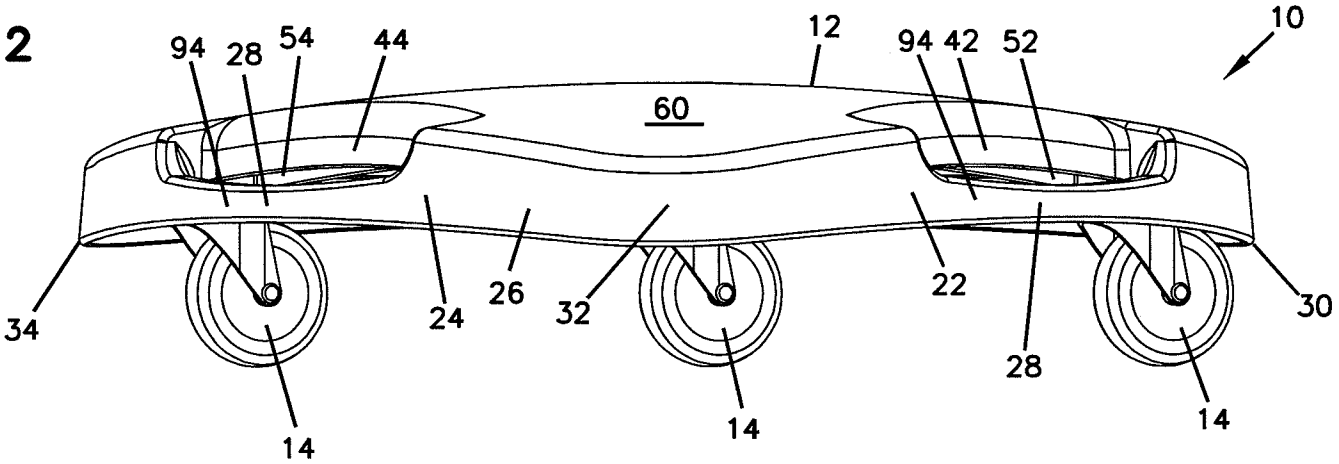
FIG. 2 is a first side view of the scooter of FIG. 1.
Figure 3:
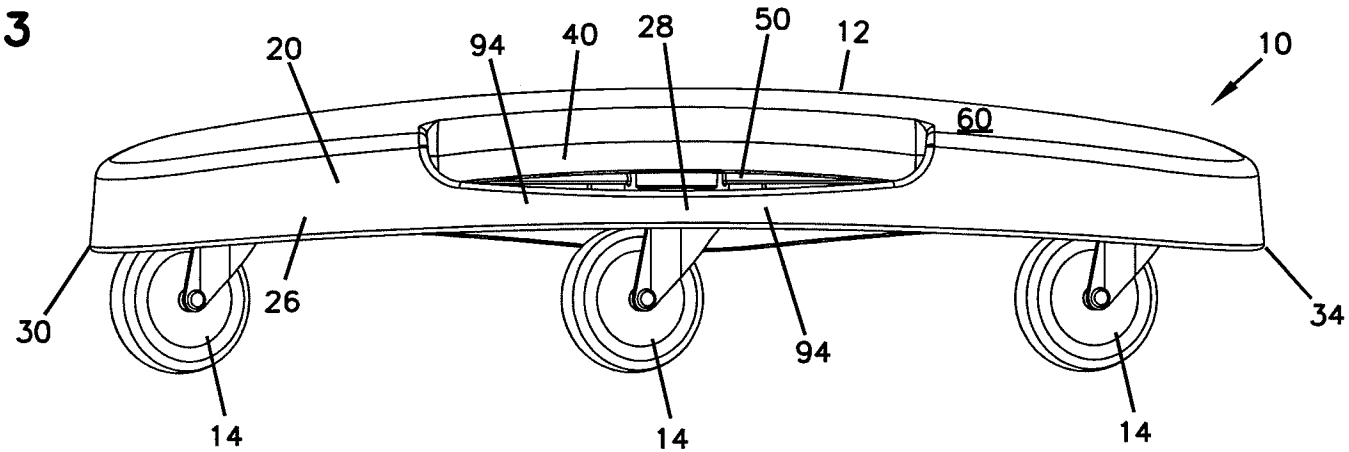
FIG. 3 is a second side view of the scooter of FIG. 1.
Figure 4:
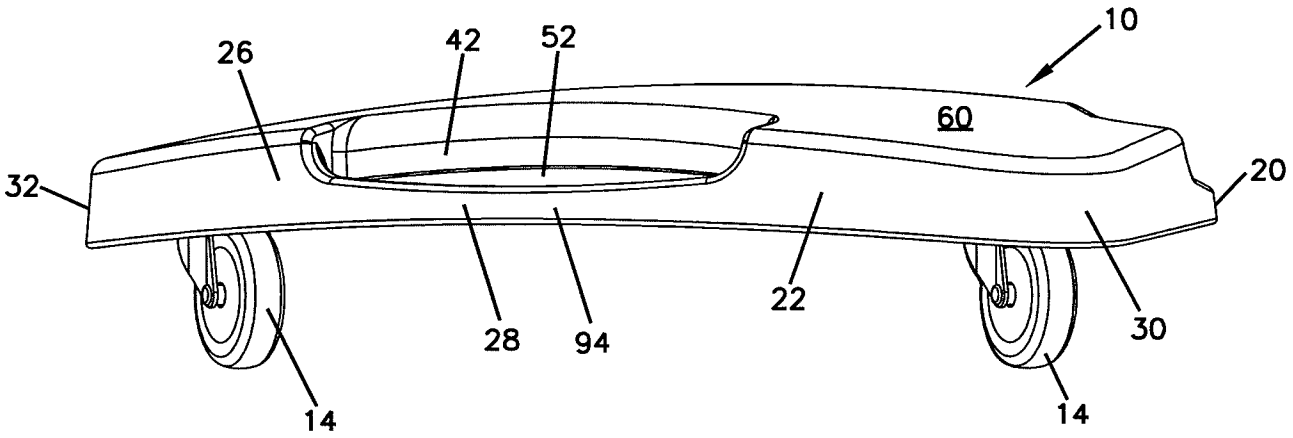
FIG. 4 is a third side view of the scooter of FIG. 1.
Figure 5:
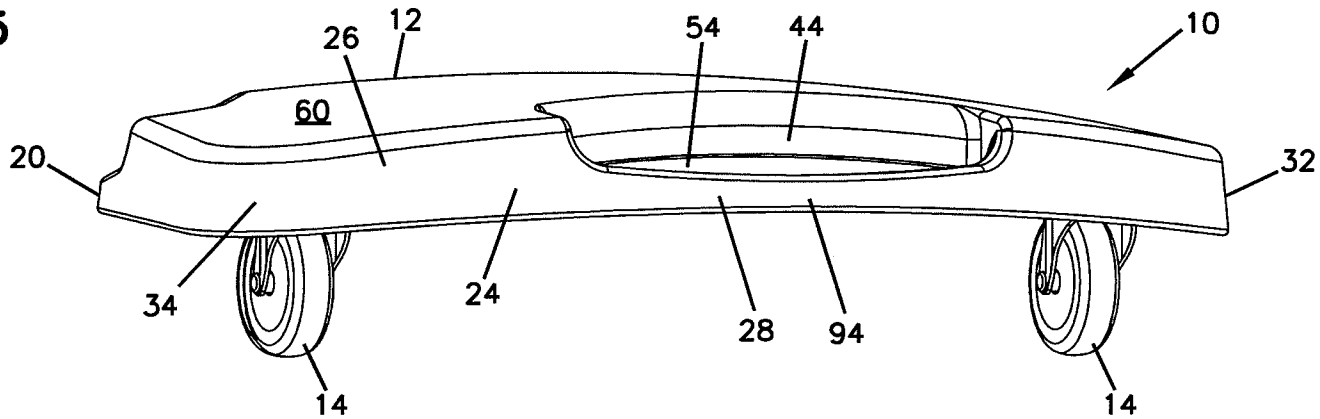
FIG. 5 is a fourth side view of the scooter of FIG. 1.
Figure 6:
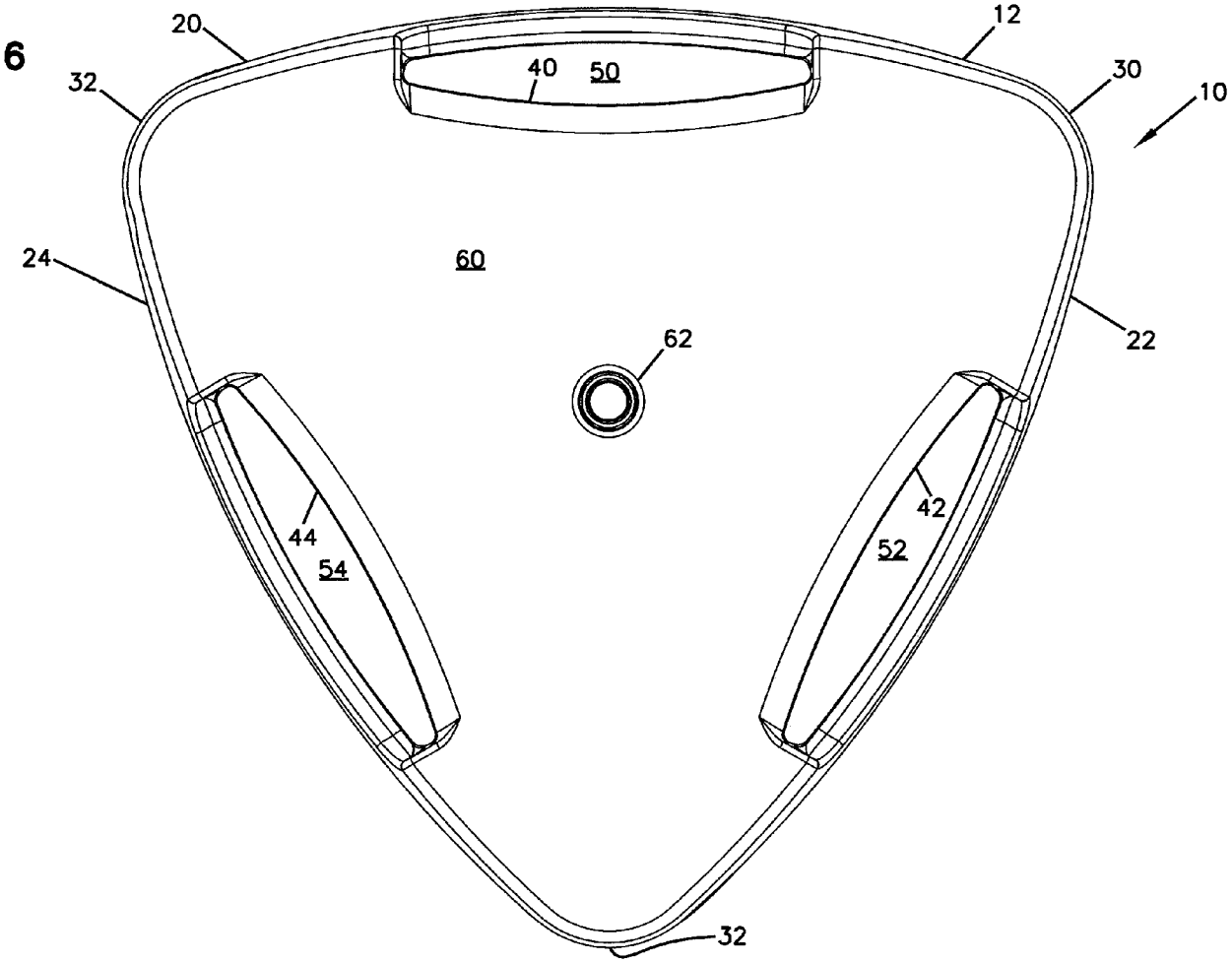
FIG. 6 is a top view of the scooter of FIG. 1.

Referring now to the FIGS. 1-10, a first embodiment of a scooter 10 is shown. Scooter 10 includes a main body 12 and a plurality of wheels 14 for engagement with a surface such as a gymnasium floor or an outdoor exercise or activity area. Wheels 14 in the illustrated embodiment are swivel caster style wheels that can rotate 360 degrees about an axis perpendicular to the floor surface.

Main body 12 has a generally triangular shape including three sides 20, 22, and 24. Main body 12 includes three corners or points 30, 32, 34. Points 30, 32, 34 together with sides 20, 22, 24 define the generally triangular shape. In the illustrated embodiment, scooter 10 is symmetrically shaped through an axis extending through one side and an opposite point. In the preferred embodiment, the scooter 10 is symmetrical through any axis through any side and its opposite point. Wheels 14 are located adjacent to a respective point 30, 32, 34. Preferably, the wheels 14 are recessed slightly inwardly from the outer periphery defined by main body 12, and do not protrude beyond the outer periphery of main body 12.

In the illustrated embodiment, sides 20, 22, 24 are slightly rounded or bowed outwardly. Further, in the illustrated embodiments, points 30, 32, 34 are rounded.

The triangular shape and three wheeled arrangement provides a stable design that is less tippable compared to designs with four or more wheels.

Main body 12 includes a plurality of handles or gripping portions 40, 42, 44 for gripping by at least one user of scooter 10. Handles 40, 42, 44 are spaced inwardly from sides 20, 22, 24. An opening 50, 52, 54 is defined adjacent to each respective handle 40, 42, 44 to allow for receipt of the user's hands. The user grips the handles 40, 42, 44 by inserting the user's hands into one or more of the openings 50, 52, 54, with palms inward and griping the top, the side and/or the bottom of handle 40, 42, 44. In one embodiment, handles 40, 42, 44 can accommodate two hands.

Top surface 60 of body 12 defines a seating surface for the user. The user then grips main body 12 at one or more handles 40, 42, 44 if desired. It is to be appreciated that top surface 60 can receive a plurality of users if desired. Further, top surface 60 can receive the user or users in a variety of positions including sitting, or laying across the top, such as by laying on the user's stomach.

Top surface 60 includes a generally domed shape wherein the highest upper portion is adjacent to a center opening 62, and the lower upper areas are adjacent to points 30, 32, 34.

Top surface 60 preferably includes a textured or roughened surface construction to prevent or reduce sliding of the user relative to the top surface 60. Such texturing can be applied during manufacture, such as by molding main body 12 from plastic and providing the texturing to the top surface.

Figure 7:
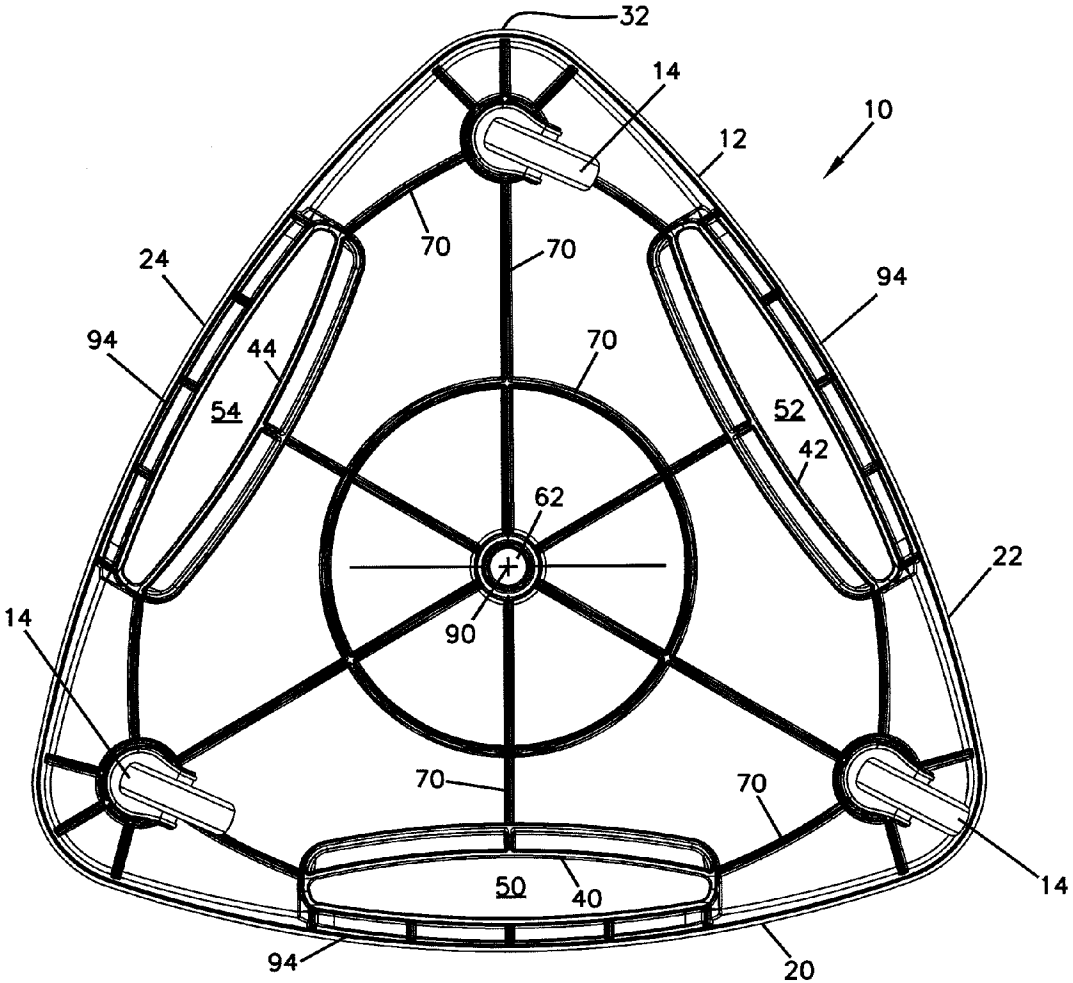
FIG. 7 is a bottom view of the scooter of FIG. 1.
Figure 10:
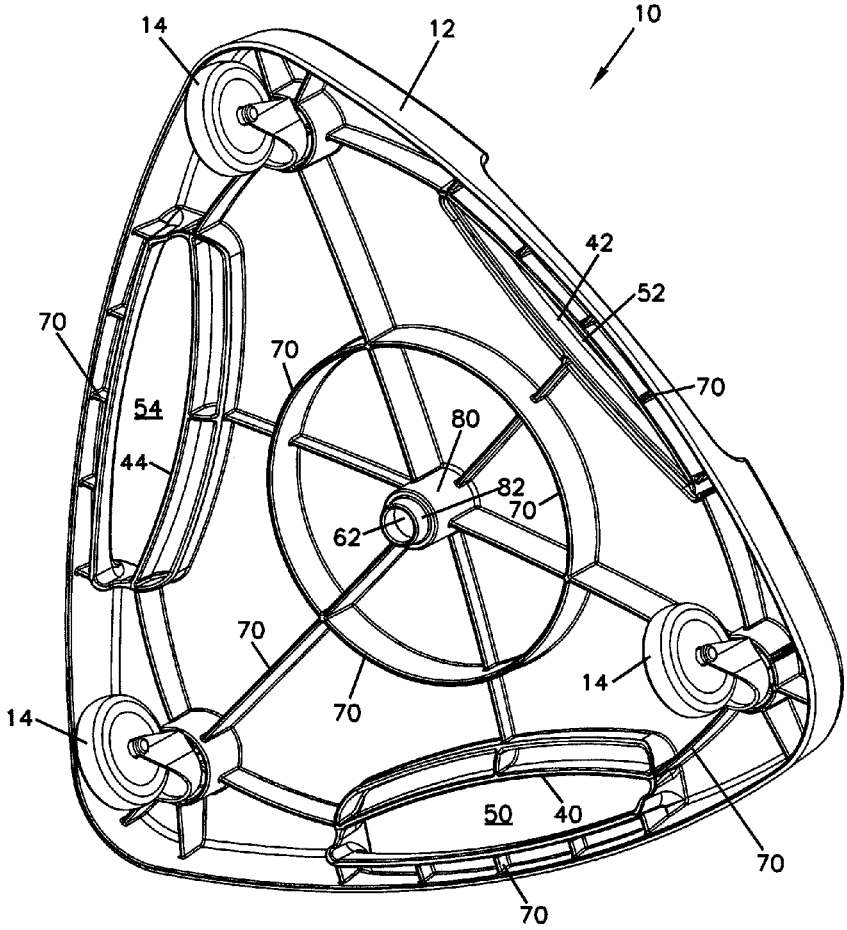
FIG. 10 is a bottom perspective view of the scooter of FIG. 1.

Referring now to FIGS. 7 and 10, main body 12 includes a plurality of ribbings or webbings 70 to improve strength without significantly increasing the unit's weight. As it can be appreciated, ribbings 70 can take a variety of shapes and numbers, as desired.

Figure 8:
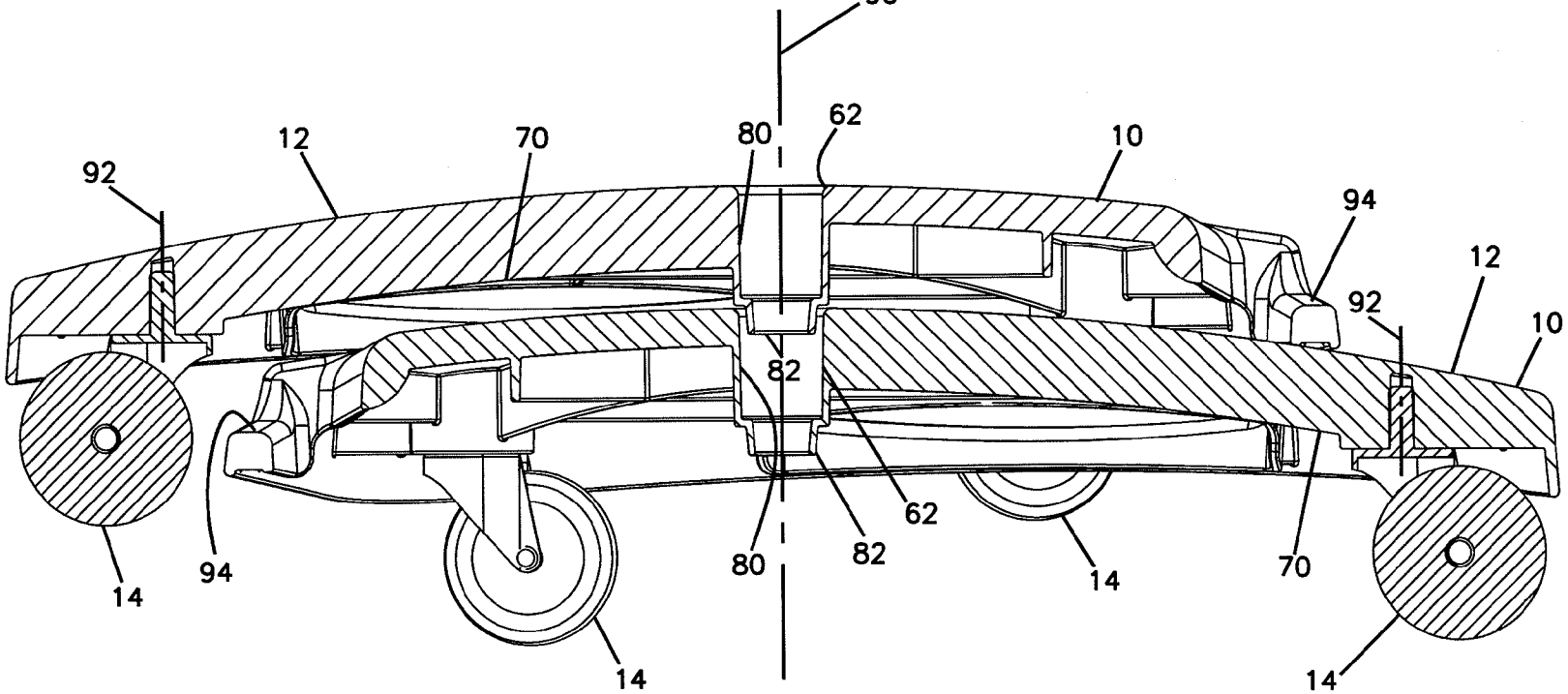
FIG. 8 is a cross-sectional side view of two scooters shown in a stacked arrangement.
Figure 9:
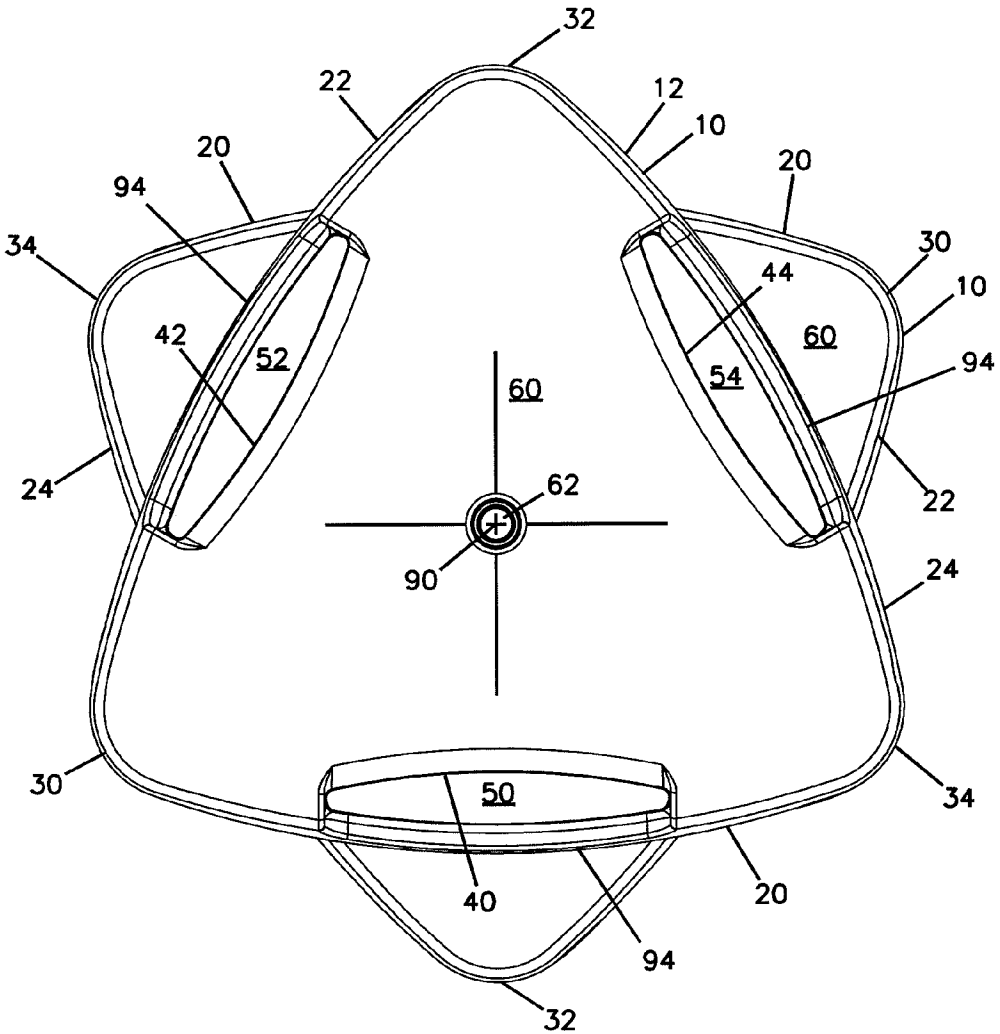
FIG. 9 is a top view of the two scooters of FIG. 8 shown in the stacked arrangement.

Center opening 62 is provided with an upper main diameter portion 80 and a lower portion 82 having a smaller outer diameter. Referring to FIGS. 8 and 9, lower portion 82 of a first scooter 10 is sized to be received in main diameter portion 80 of a second scooter 10 positioned below the first scooter. In this manner, the scooters can be stacked for storage.

In FIGS. 8 and 9, only two scooters 10 are shown stacked together for storage. It is to be appreciated that a plurality of additional scooters can be stacked, such as 6-12, or more. When stacking the scooters 10, they are alternated back and forth in a repeating pattern as shown in FIGS. 8 and 9 along axis 90. During stacking, the scooters are alternated so that the wheels of the scooter positioned above do not interfere with the scooter below, thereby resulting in more compact storage. The alternating is oriented at 60 degrees offset. A 180 degree offset is also possible. A nesting effect is created by the offset. In some embodiments, 24 scooters can be conveniently placed in one stack.

With the noted storage feature, the scooters 10 are self-stacking in the preferred arrangement, in that no stacking pole or other storage cart is needed. Also, the compact fit allows more scooters 10 to be stored than if they were stacked bottom to top (bottom of the wheels to top of the underneath scooter) where there was no overlap.

Sides 20, 22, 24 of main body 12 include a main thickness 26 adjacent to each point 30, 32, 34 and a portion of each side 20, 22, 24. Along a center of sides 20, 22, 24 adjacent to each handle 40, 42, 44 is a thinner portion 28. Thinner portion 28 defines a carrying handle 94. Carrying handle 94 also protects the hands of the user or users in handles 40, 42, 44 from being contacted by walls, objects or another scooter.

Carrying handles 94 do not project outwardly from sides 20, 22, 24, and instead are part of the smooth curve of the sides 20, 22, 24 connecting the points 30, 32, 34. The non-protruding wheels protect the wheels from contacting walls, objects, or another scooter.

Wheels 14 each pivot about a wheel axis 92 so that scooter 10 can be moved in any direction, such as in a straight path or a curved path as directed by the user or someone pushing the user. The user moves the scooter 10 by pushing with the user's hands and/or feet, or with a stick or other oar-like object. Also, the user can be pushed by another person pushing on the scooter or the user.

The wheels 14 can be press-fit or snap mounted to main body 12. Different wheels can be provided for scooter 10, depending on cost, desired speed, type of surface the scooter 10 will be used on, or other factors.

Scooter 10 can be used in a variety of manners for exercise or entertainment, including racing, in games with balls or objects, and in agility training or testing.

What is claimed is:

1. A scooter comprising:

a main body including a top surface extending between three sidewalls that intersect at three points to define a generally triangularly-shaped outer perimeter of the main body, each of the three sidewalls extending along a length between a respective two of the points, each of the three sidewalls being outwardly bowed along an entirety of the respective length;

three wheels coupled to the main body, each of the wheels being located adjacent to an intersection of a respective two of the three sidewalls, each of the wheels including a swivel caster wheel, and each of the wheels being sufficiently inwardly offset from the outer perimeter of the main body to not extend beyond the outer perimeter;

three handles, each handle being defined by a respective edge of the top surface formed by a respective opening through the top surface of the main body, each of the handles being located adjacent to a center of a respective one of the sidewalls;

the top surface of the main body having a domed shape with a highest location adjacent to a center of the main body and a plurality of lower locations at the intersections.

2. The scooter of claim 1, wherein the top surface includes a textured surface.

3. The scooter of claim 1, wherein the main body includes a central opening extending vertically through the main body.

4. The scooter of claim 3, wherein the central opening includes an upper main diameter portion and a lower smaller diameter portion.

5. A scooter body comprising:

a main body having a triangular shaped outer perimeter formed by three sidewalls of equal length, the main body also having a domed surface extending between the three sidewalls, the domed surface having a highest location adjacent to a center of the main body and a plurality of lower locations adjacent intersections of pairs of the sidewalls;

three wheel mounts coupled to the main body, one of the wheel mounts being located adjacent to the intersection of a respective pair of the sidewalls;

three handles, each handle being defined by an opening through the main body, one of the handles being located adjacent to a center of each sidewall; and three carrying handles disposed adjacent to the three handles, each carrying handle being defined by a portion of a respective one of the sidewalls so that the carrying handles define part of the triangular shaped outer perimeter of the main body, the portions of the sidewalls of the carrying handles having thinner vertical dimensions than portions of the sidewalls on opposite ends of the carrying handles.

6. The scooter of claim 5, wherein the top surface includes a textured surface.

7. The scooter of claim 5, wherein the openings which form the handles are located within the outer perimeter of the main body, wherein the sidewalls define outwardly bowed continuous contours extending between the intersections.

8. The scooter of claim 5, wherein the main body includes a central opening extending vertically through the main body.

9. The scooter of claim 8, wherein the central opening includes a upper main diameter portion and a lower smaller diameter portion.

10. A stack of scooters comprising:

a plurality of separate scooters, each scooter including:

a main body having a triangular shape formed by three intersecting sidewalls, the main body also including a domed top surface;

three wheels, each of the wheels being located adjacent to a respective one of the intersections of the sidewalls, each of the wheels including a swivel caster wheel;

three handles, each handle being defined by an opening through the main body, each of the handles being located adjacent to a center of a respective one of the sidewalls;

the main body having an extension defining a central passage extending vertically through the main body and the extension, wherein the main body and a portion of the extension defines an upper main diameter portion and another portion of the extension defines a lower smaller diameter portion that is vertically aligned with the upper main diameter portion;

wherein the scooters are stacked and alternated back and forth in a repeating pattern so that the extensions of the scooters align along a central vertical axis, wherein the lower smaller diameter portion of a first scooter of the plurality of the separate scooters is sized to be received in the upper main diameter portion of a second scooter of the plurality of the separate scooters positioned below the first scooter, wherein the wheels of the first scooter positioned above the second scooter do not interfere with the scooter below, wherein the alternating scooters are oriented at an offset.

11. The stack of scooters of claim 10, wherein the top surface of each scooter includes a textured surface.

12. The stack of scooters of claim 10, wherein the openings which form the handles are located within an outer perimeter of the main body, wherein the sidewalls define outwardly bowed shapes.

13. The stack of scooters of claim 10, wherein the main body of each scooter includes a carrying handle adjacent to each handle, the carrying handle having a thinner vertical dimension than portions of the sides on opposite ends of the carrying handle.

14. A method of stacking scooters comprising:

providing a plurality of separate scooters, each scooter including:

a main body having a triangular shape including three equal sides and three equal points;

three wheels, one of the wheels being located adjacent to each point, each of the wheels including a swivel caster wheel;

three handles, each handle defined by an opening through the main body, one of the handles being located adjacent to a center of each side;

the main body having an extension defining a central passage extending vertically through the main body and the extension, wherein the main body and a portion of the extension defines an upper main diameter portion and a lower smaller diameter portion that is vertically aligned with the upper main diameter portion; and stacking the scooters in a vertical stack so that the scooters are alternated back and forth in a repeating pattern so that the extensions of the scooters align along a central vertical axis and so that the lower smaller diameter portion of a first scooter of the plurality of the separate scooters is received in the upper main diameter portion of a second scooter of the plurality of the separate scooters positioned below the first scooter, wherein the wheels of the first scooter positioned above the second scooter do not interfere with the scooter below, wherein the alternating scooters are oriented at an offset, and wherein the scooters overlap and are nested within one another.

15. The method of claim 14, wherein at least 3 scooters are provided.

16. The method of claim 15, wherein at least 6 scooters are provided.

17. The method of claim 16, wherein at least 12 scooters are provided.

18. The method of claim 17, wherein at least 24 scooters are provided.

19. The method of claim 14, wherein no pole or other external holder is used to maintain the stack in vertical alignment.

* * * * *